United States Patent [19]

Ishikawa

[11] Patent Number: 5,069,437

[45] Date of Patent: Dec. 3, 1991

[54] DUPLEX PRINTING APPARATUS

[75] Inventor: Yasushi Ishikawa, Tokyo, Japan

[73] Assignee: Seikosha Co., Ltd., Tokyo, Japan

[21] Appl. No.: 458,126

[22] Filed: Dec. 28, 1989

[30] Foreign Application Priority Data

Dec. 29, 1988 [JP] Japan ..... 63-331209

[51] Int. Cl.[5] ..... B65H 5/22

[52] U.S. Cl. ..... 271/3.1; 271/9; 271/65; 271/301

[58] Field of Search ..... 271/3, 4, 9, 10, 225, 271/163, 301, 303, 65, 184, 185, 186, 3.1, 162; 355/319

[56] References Cited

U.S. PATENT DOCUMENTS

| | | | |
|---|---|---|---|
| 3,869,202 | 3/1975 | Tabata et al. | 271/3 X |
| 4,190,354 | 2/1980 | Smith et al. | 355/319 X |
| 4,272,180 | 6/1981 | Satomi et al. | 355/319 X |
| 4,708,462 | 11/1987 | Stemmle | 355/319 X |

FOREIGN PATENT DOCUMENTS

| | | | |
|---|---|---|---|
| 1128295 | 4/1962 | Fed. Rep. of Germany | 271/4 |

*Primary Examiner*—Robert P. Olszewski
*Assistant Examiner*—Cheryl L. Gastineau
*Attorney, Agent, or Firm*—Jordan and Hamburg

[57] ABSTRACT

A duplex printing apparatus includes a first conveyance device for supplying recording paper from a first paper supply tray to a printing device; a second conveyance device for supplying the recording paper from a second paper supply tray to the printing device; a third conveyance device for conveying the recording paper printed by the printing device to a paper receiving tray; a fourth conveyance device for conveying the recording paper to the second paper supply tray; a paper switching device disposed at the third conveyance device and operable to selectively send the recording paper printed by the printing device to the second paper receiving tray or to the fourth conveyance device; and a driving mechanism for the second paper supply tray which is operable to move the second paper supply tray to one position for receiving the recording paper from the fourth conveyance device and to another position in which the second paper supply tray supplies the recording paper to the printing device.

18 Claims, 2 Drawing Sheets

DUPLEX PRINTING APPARATUS

BACKGROUND OF THE INVENTION

1. Field of the Invention

The present invention relates to a duplex printing apparatus for effecting printing on both sides of one sheet of recording paper.

2. Description of the Related Art

Conventionally, a printing apparatus is known for effecting so called duplex printing in which images are formed on both sides of one sheet of recording paper. In this case, the recording paper is first fed to a printing means, and after printing is effected on one side thereof, the recording paper is inverted and fed again to the printing means. As an example of an apparatus for supplying the recording paper for this purpose, an apparatus having the following is known: a paper supply tray for stacking and accommodating new recording paper for which printing has not been effected; a first conveyance means for supplying the sheets of recording paper on the paper supply tray one by one to the printing means; an inverting device for inverting the recording sheet which has been supplied to the printing means and on one side of which printing has been effected; an intermediate tray for receiving the inverted recording paper; and a second conveyance means for supplying the sheets of recording paper on the intermediate tray one by one to the printing means.

With the above described conventional apparatus, however, it is necessary to provide a special arrangement for duplex printing, including the intermediate tray and the second conveyance means. Consequently, there are drawbacks in that the number of parts used is numerous, the assembly is cumbersome, and production costs are high.

SUMMARY OF THE INVENTION

Accordingly, an object of the present invention is to provide a duplex printing apparatus which does not require a special arrangement, thereby overcoming the above described drawbacks of the conventional art.

To this end, in accordance with the present invention, there is provided a duplex printing apparatus comprising: first conveyance means for supplying recording paper from a first paper supply tray to printing means; second conveyance means for supplying the recording paper from a second paper supply tray to the printing means; third conveyance means for conveying the recording paper printed by the printing means to a paper receiving tray; fourth conveyance means for conveying the recording paper to the second paper supply tray; paper switching means disposed at the third conveyance means and operable to selectively send the recording paper printed by the printing means to the paper receiving tray or to the fourth conveyance means; and a driving mechanism for the second paper supply tray which is operable to move the second paper supply tray to one position for receiving the recording paper from the fourth conveyance means and to another position in which the second paper supply tray supplies the recording paper to the printing device.

In accordance with the present invention, at the time of effecting duplex printing, an existing paper supply tray provided for single-side printing also serves as an intermediate tray for temporarily receiving recording paper on one side of which printing has been effected. Accordingly, it is possible to effect duplex printing without requiring any special mechanism, and it is possible to realize a compact apparatus, contributing to a reduction in production costs.

The above and other objects, features and advantages of the invention will become more apparent from the following detailed description of the invention when read in conjunction with the accompany drawings.

BRIEF DESCRIPTION OF THE DRAWINGS

The drawings illustrate an embodiment of a duplex printing apparatus in accordance with the present invention, in which.

DESCRIPTION OF THE PREFERRED EMBODIMENT

Figure 1:
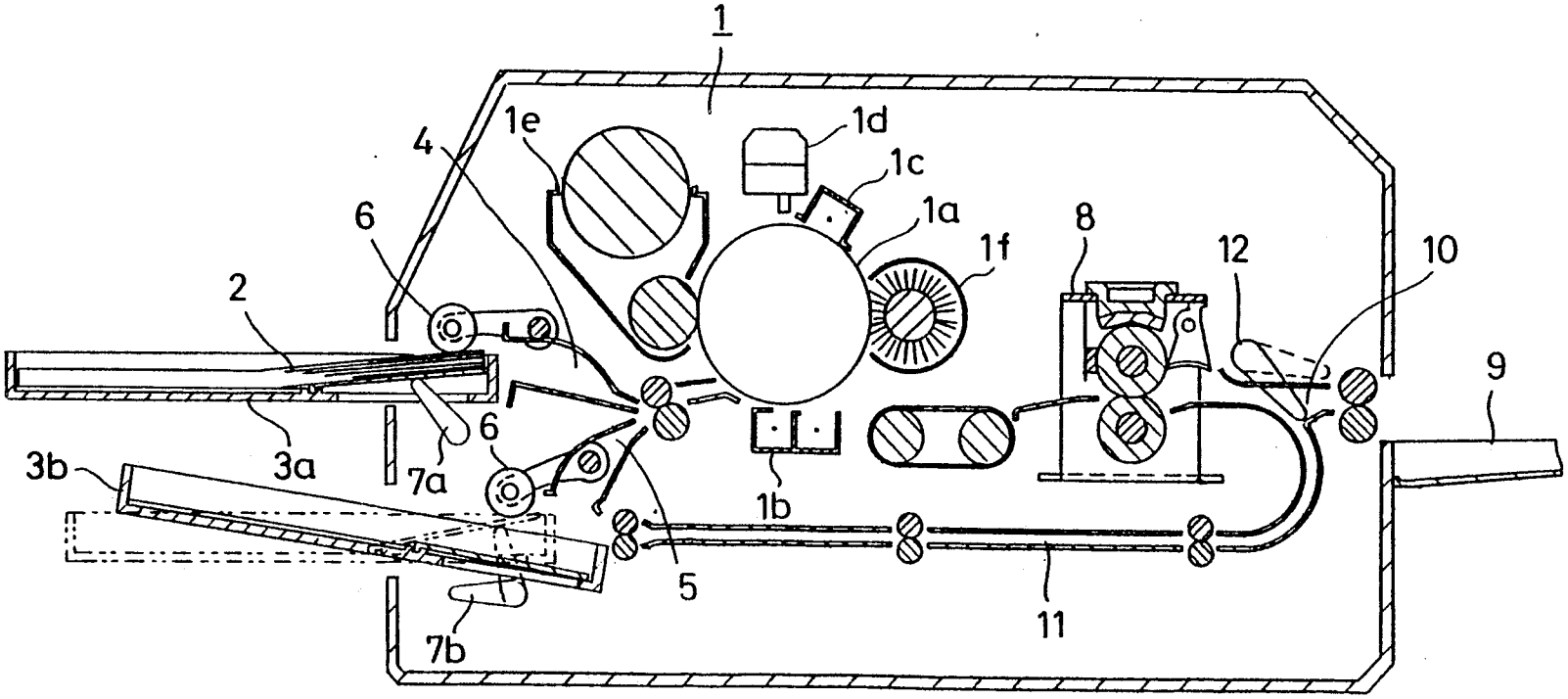
FIG. 1 is a cross-sectional view.

Referring now to the accompanying drawings, a description will be given of an embodiment of the present invention which is applied to an electrophotographic recording system. As shown in FIG. 1, a printing means 1 for recording data stored in a data buffer on recording paper 2 in response to an address signal sent from a central processing unit includes a photosensitive drum 1*a* and a transfer means 1*b*. Disposed in order from an upstream side on an outer periphery of the photosensitive drum 1*a* are a charging device 1*c*, an electrostatic latent image forming device 1*d*, a developing device le, a transfer means 1*b*, a cleaning device 1*f*, and an electricity eliminating device (not shown). Unprinted recording paper 2 is stocked in a stacked state on a paper supply tray 3*a*. A pair of paper feed rollers 6 for feeding the recording paper 2 from the paper supply trays 3*a*, 3*b* to the printing means 1 via first and second conveyance means 4, 5 are respectively provided above the paper supply trays 3*a*, 3*b*. Also, shift levers 7*a*, 7*b* are respectively provided in lower portions of the paper supply trays 3*a*, 3*b* and are adapted to be lowered when the paper supply trays 3*a*, 3*b* are loaded in the apparatus and when the recording paper 2 is replenished for the paper supply trays 3*a*, 3*b* loaded in the apparatus, thereby allowing these operations to be performed. Meanwhile, when the recording paper 2 is supplied, these shift levers 7*a*, 7*b* are raised so as to bring the recording paper 2 into close contact with the paper feed rollers 6. In addition, a fixing device 8 for fixing a toner image adhering to the recording paper 2 by means of heat fixing, pressure fixing, or the like is provided at a portion where the recording paper 2 has come out of the printing means 1. A fourth conveyance means 11 for conveying the recording paper 2 to the paper supply tray 3*b* is connected to a third conveyance means 10 for conveying the recording paper 2 which has come out of the fixing device 8 to a paper receiving tray 9. The third conveyance means 10 is provided with a paper switching device 12 for selectively sending the recording paper 2 to the fourth conveyance means 11.

Figure 2:
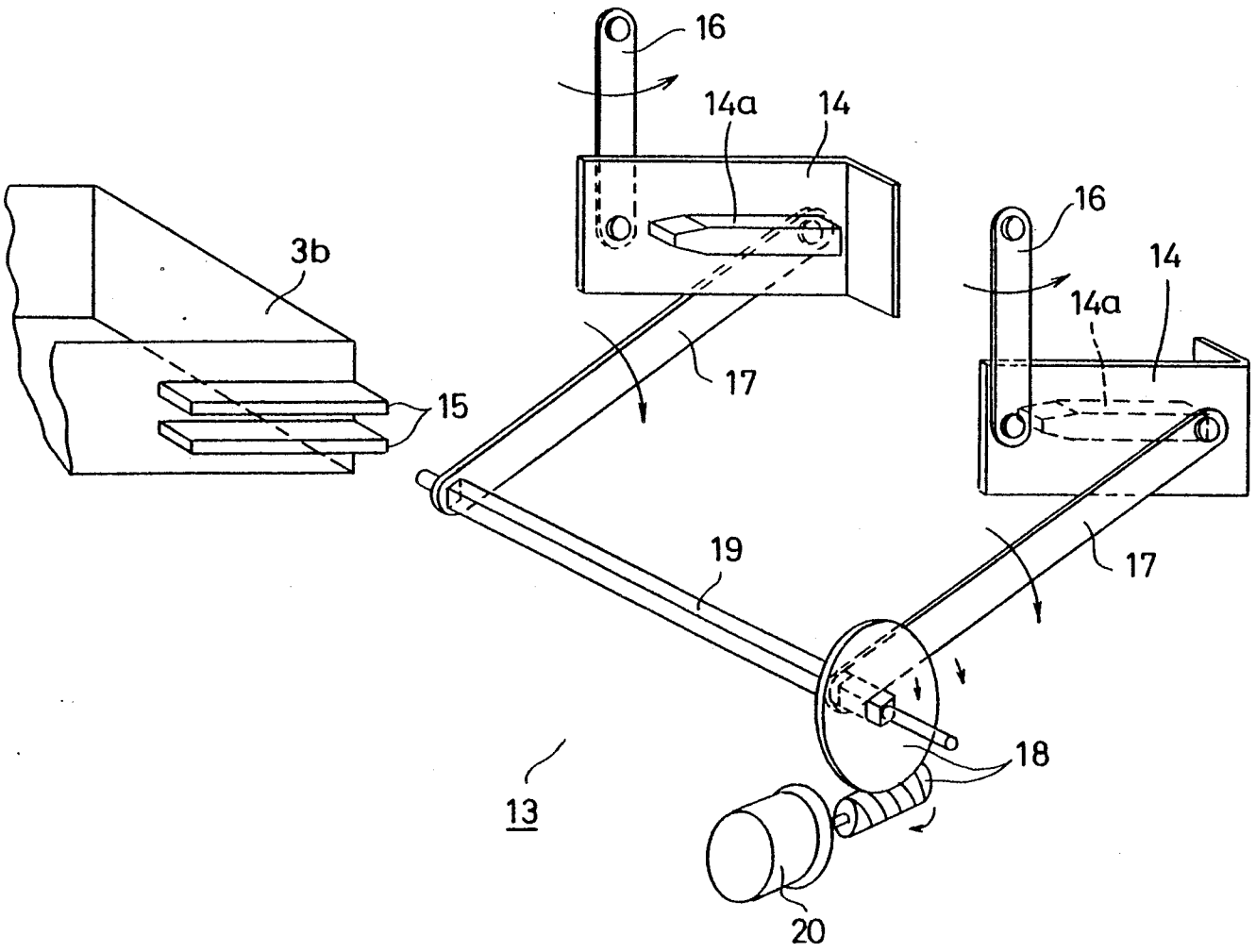
FIG. 2 is an enlarged perspective view of a driving mechanism for a paper supply tray.

Referring now to FIG. 2, a description will be given of a driving mechanism 13 for a paper supply tray for driving the paper supply tray 3*b*. A pair of projections 14*a* are provided on side walls of a pair of paper supply tray receivers 14 in such a manner as to oppose each other. As each of the projections 14*a* is fitted in a gap formed by two protrusions 15 (one side is not shown) provided on each side wall of the paper supply tray 3*b*, the pair of paper supply tray receivers 14 are adapted to hold the paper supply tray 3*b*. The pair of paper supply tray receivers 14 are respectively rotatably engaged with a pair of supporting levers 16 provided rotatably on an apparatus body (not shown) and are also rotatably engaged with a pair of driving levers 17. The driving levers 17 are fitted with a shaft 19 fitting with a gear train 18 and can be driven by a motor 20 via the gear train 18 and the shaft 19.

The operation will now be described with reference to FIGS. 1 and 2. The recording paper 2 in the paper supply tray 3*a* is brought into contact with the paper feed roller 6 as the shift lever 7*a* is raised, and a first sheet of recording paper passes through the first conveyance means 4 by paper feed roller 6 so as to undergo printing on its surface (first page) by means of the printing means 1. Then, fixing is effected by the fixing device 8 and that recording paper is sent to the third conveyance means 10. In the case of single-side printing, the paper switching device 12 is switched over to the position indicated by the broken line in FIG. 1, so that the first sheet of recording paper is discharged to the paper receiving tray 9. In the case of duplex printing, the paper switching device 12 is switched over to the position indicated by the solid line in FIG. 1, and the first sheet of recording paper is sent to the fourth conveyance means 11 so as to be delivered to the other paper supply tray 3*b*. At this time, the paper supply tray 3*b* is held by the driving mechanism 13 for a paper supply tray at a position suitable for receiving the recording paper 2, as indicated by the solid line in FIG. 1. To describe the operation at this time of the driving mechanism 13 for a paper supply tray, the motor 20 first drives the pair of driving levers 17 in the direction of the arrows shown in FIG. 2 via the gear train 18 and the shaft 19. (The gears of the gear train 18 rotate in the directions of the arrows shown in FIG. 2.) At this time, the pair of support levers 16 rotate in the directions of the arrows shown in FIG. 2, and the paper supply tray 3*b* held by the pair of paper supply tray receivers 14 moves from the position indicated by the two dotted chain line in FIG. 1 to the position indicated by the solid line and is held in that position.

When printing is to be effected on only one sheet of recording paper, the motor 20 is subsequently rotated in an opposite direction to the one mentioned above, with the result that the driving mechanism 13 for a paper supply tray is driven in the opposite direction to the one referred to above, and the paper supply tray 3*b* is moved to a position suitable for supplying the paper as indicated by the two dotted chain line in FIG. 1 and is held in that position. The first sheet of recording paper in the paper supply tray 3*b* with its unprinted side facing upward is brought into pressure contact with the paper feed roller 6 as the shift lever 7*b* is raised, and the first sheet of recording paper passes through the second conveyance means 5 by means of the paper feed roller 6, so that printing is effected on its rear side (second page) by means of the printing means 1. The first sheet of recording paper both sides of which have been printed is discharged to the paper receiving tray 9 via the fixing device 8 and the third conveyance means 10. At this time, the paper switching device 12 has been switched over to the position indicated by the broken line in FIG. 1.

A description will now be given of a case in which duplex printing is continuously effected on a plurality of sheets of paper. The operation is the same as described above until printing is effected on one side (first page) of the first sheet of recording paper and the first sheet of recording paper is delivered to the paper supply tray 3*b*. Subsequently, a second sheet of the recording paper is fed from the paper supply tray 3*a* to the printing means 1, and after one side thereof is printed, it is delivered to the paper supply tray 3*b*. At this time, the paper supply tray 3*b* remains held in the position indicated by the solid line in FIG. 1. Similarly, when third, fourth, and ensuing sheets of recording paper are consecutively delivered to the paper supply tray 3*b* and the aforementioned operations are completed with respect to all the sheets to be printed, the paper supply tray 3*b* is moved to the position indicated by the two-dotted chain line in FIG. 1 by means of the driving mechanism 13 for a paper supply tray and is held in that position. Then, the sheets of recording paper which are accommodated in the paper supply tray 3*b* and for which one side printing has been effected consecutively undergo printing on their rear sides by the printing means 1 in the same way as the above-described duplex printing of only one sheet. The sheets of recording paper for which duplex printing has been completed are consecutively discharged to the paper receiving tray 9 via the fixing device 8 and the third conveyance means 10. At this time, the paper switching means 12 has been switched over to the position indicated by the broken line in FIG. 1. The order of printing in terms of the page number is 1, 3, 5, ..., (N−1), N, (N−2), ..., 4, 2 (where N is an even number, a value double the total number of sheets to be printed).

It should be noted that in order to prevent the top and the bottom for printing from becoming reversed on the obverse and reverse sides of the recording paper, it is readily possible to effect proper printing such as by sending an address signal from the central processing unit in the opposite order to the case of the obverse sides of the recording paper.

In addition, the order of duplex printing is not confined to that of the above-described embodiment, and the printing of the second, third, and ensuing sheets of recording paper may be consecutively effected in a similar manner after the printing of the first page and the second page is effected on the obverse and reverse sides of the first sheet of recording paper.

Furthermore, when duplex printing is not effected, the paper supply tray 3*b* can be used as a paper supplying means for stacking the recording paper and effecting single-side printing.

In accordance with the present invention, duplex printing is possible without providing any special mechanism, and it is unnecessary to increase the number of parts used. Also, the apparatus is easy to produce and can be made compact, contributing to a reduction in production costs.

Although the present invention has been described through specific terms, it should be noted here that the described embodiments are not necessarily exclusive and the various changes and modifications may be imparted thereto without departing from the scope of the invention which is limited solely by the appended claim.

What I claim is:

1. A duplex printing apparatus having a printing means comprising:

first conveyance means for supplying non-printed recording paper from a first paper supply tray to said printing means;

second conveyance means for supplying non-printed recording paper from a second paper supply tray to said printing means;

third conveyance means for conveying the recording paper printed by said printing means to a paper receiving tray;

fourth conveyance means for conveying the recording paper printed by said printing means to said second paper supply tray;

paper switching means disposed at said third conveyance means operable to selectively send the recording paper printed by said printing means to said paper receiving tray or to said fourth conveyance means; and a driving mechanism for said second paper supply tray which is operable to move said second paper supply tray to one position to receive the recording paper from said fourth conveyance means and to another position in which said second paper supply tray supplies said recording paper to said second conveyance means.

2. A duplex printing apparatus according to claim 1 wherein said second conveyance means has an entrance section, said fourth conveyance means having an exit section, said second paper supply tray having a forward end juxtaposed to said entrance section of said second conveyance means when said second paper tray is in said other position, said forward end of said second paper supply tray being juxtaposed to said exit section of said fourth conveyance means when said second paper supply tray is in said one position.

3. A duplex printing apparatus according to claim 2 wherein said entrance section of said second conveyance means is disposed at a higher elevation than said exit section of said fourth conveyance means.

4. A duplex printing apparatus according to claim 2 wherein said entrance section of said second conveyance means is disposed downstream of said exit section of said fourth conveyance means considered in the direction of movement of said recording paper along said fourth conveyance means.

5. A duplex printing apparatus according to claim 1 wherein said fourth conveyance means is operable to convey said recording paper to said second paper supply tray when the latter is in said one position, and said second conveyance means is operable to convey said recording paper from said second paper supply tray when the latter is in said other position.

6. A duplex printing apparatus according to claim 1 wherein said driving means comprises engaging means operable to engage said second paper supply tray to move the latter between said one and said other position.

7. A duplex printing apparatus according to claim 1 said second paper supply tray.

8. A duplex printing apparatus according to claim 1 wherein said drive means comprises pivot means operable to pivot said second paper supply tray.

9. A duplex printing apparatus having a printing means comprising:

first conveyance means for supplying non-printed recording paper from a first paper supply tray to said printing means;

second conveyance means for supplying non-printed recording paper from a second paper supply tray to said printing means;

third conveyance means for conveying the recording paper printed by said printing means to a paper receiving tray;

operable means disposed at said third conveyance means operable to selectively send the recording paper printed by said printing means to said paper receiving tray or to one of said paper supply trays; and a driving mechanism for said one paper supply tray which is operable to move said one paper supply tray to one operable position to receive the recording paper from said operable means and to another operable position in which said one paper supply tray supplies the top recording paper in said one paper supply tray to one of the first and second conveyance means which is associated with said one paper supply tray.

10. A duplex printing apparatus according to claim 9 wherein said drive means is operable to engage said one paper supply tray and change its position when said one paper supply tray is moved between said operable positions.

11. A duplex printing apparatus according to claim 9 wherein said drive means is operable to engage said one paper supply tray and change its orientation when said one paper supply tray is moved between said operable positions.

12. A duplex printing apparatus according to claim 9 wherein said drive means is operable to engage and effect tilting of said one paper supply tray when said one paper supply tray is moved between said operable positions.

13. A duplex printing apparatus according to claim 1, wherein said second conveyance means conveys the top sheet in said second paper supply tray to said printing means.

14. A duplex printing apparatus according to claim 1, wherein said second paper supply tray is operable to stock non-printed recording paper and said second conveyance means is operable to feed said non-printed recording papers from said stack to said printing means to effect single sided copying thereof when duplex printing is not being effected.

15. A duplex printing apparatus according to claim 1, wherein said fourth conveyance means deposits said recorded paper as the top sheet of said second paper supply tray, and said second conveyance means conveys the top sheet in said second paper supply tray to said printing means.

16. A duplex printing apparatus according to claim 1, wherein said second paper supply tray has a bottom which supports the recorded sheets in said record paper supply tray, said driving mechanism being operable to move the entire second paper supply tray, including all the recorded sheets in said second paper supply tray and including said bottom, between said one and said other positions.

17. A duplex printing apparatus according to claim 2, wherein said second paper supply tray is aligned with said exit section and non-aligned with said entrance section when said second paper supply tray is in said one position, said second paper supply tray being aligned with entrance section and non-aligned with said exit section when said second paper supply tray is in said other position.

18. A duplex printing apparatus having a printing means comprising:

first conveyance means for supplying non-printed recording paper from a first paper supply tray to said printing means;

second conveyance means for supplying non-printed recording paper from a second paper supply tray to said printing means;

third conveyance means for conveying the recording paper printed by said printing means to a paper receiving tray;

fourth conveyance means for conveying the recording paper printed by said printed means to aid second paper supply tray;

paper switching means disposed at said third conveyance means operable to selectively send the recording paper printed by said printing means to said paper receiving tray or to said fourth conveyance means; and a driving mechanism for said second paper supply tray which is operable to move said second paper supply tray to one position to receive as the recording paper the recording paper from said fourth conveyance means and to another position in which said second paper supply tray supplies the top recording paper in said second paper supply tray to said second conveyance means.

* * * * *